US008950343B2

(12) United States Patent
Huang

(10) Patent No.: US 8,950,343 B2
(45) Date of Patent: Feb. 10, 2015

(54) ADJUSTABLE TABLE WITH AN ASSISTANT DEVICE

(71) Applicant: Hui-Ling Huang, Taichung (TW)

(72) Inventor: Hui-Ling Huang, Taichung (TW)

( * ) Notice: Subject to any disclaimer, the term of this patent is extended or adjusted under 35 U.S.C. 154(b) by 0 days.

(21) Appl. No.: 13/930,197

(22) Filed: Jun. 28, 2013

(65) Prior Publication Data

US 2014/0041554 A1 Feb. 13, 2014

(30) Foreign Application Priority Data

Aug. 7, 2012 (TW) ..... 101215178 A

(51) Int. Cl.
*A47B 3/02* (2006.01)
*A47B 9/16* (2006.01)

(52) U.S. Cl.
CPC .... *A47B 9/16* (2013.01); *A47B 3/02* (2013.01)
USPC ..... 108/116; 108/118

(58) Field of Classification Search
CPC ..... A47B 1/00; A47B 1/08; A47B 1/056; A47B 3/02; A47B 9/16; A47B 1/02; A47B 1/03; A47B 2001/035
USPC ..... 108/116, 117, 118, 120, 145; 248/176.3, 346.06, 346.07; 280/641, 280/47.24, 43.16, 47.37
See application file for complete search history.

(56) References Cited

U.S. PATENT DOCUMENTS

| | | | | | |
|---|---|---|---|---|---|
| 136,357 | A * | 3/1873 | Belford | 108/116 |
| 2,624,535 | A * | 1/1953 | Bollhoefer | 248/669 |
| 2,733,109 | A * | 1/1956 | Dooley et al. | 108/20 |
| 3,001,559 | A * | 9/1961 | Szopo | 144/286.1 |
| 4,967,672 | A * | 11/1990 | Leather | 108/120 |
| 5,588,377 | A * | 12/1996 | Fahmian | 108/145 |
| 5,636,711 | A * | 6/1997 | Nussbaum | 187/211 |
| 5,829,948 | A * | 11/1998 | Becklund | 414/607 |
| 7,032,872 | B2 * | 4/2006 | Sullivan | 248/346.07 |
| 7,059,616 | B2 * | 6/2006 | Wu | 280/47.24 |
| 7,677,518 | B2 * | 3/2010 | Chouinard et al. | 248/370 |
| 2014/0144352 | A1 * | 5/2014 | Roberts | 108/96 |

* cited by examiner

*Primary Examiner* — Janet M Wilkens
(74) *Attorney, Agent, or Firm* — Muncy, Geissler, Olds & Lowe, P.C.

(57) ABSTRACT

An adjustable table includes a table board, a first foot, a second foot, an air pressure bar and an assistant device. The first foot crossly and pivotally connects with the second foot, wherein one end of the first foot pivotally connects with a first fastener on the bottom side of the table board, and one end of the second foot pivotally connects with a pivot joint. The assistant device is fixed between the first fastener and a second fastener, wherein one end of the air pressure bar is fixed on the second fastener while the other end fixed on the assistant device. Therefore, when the air pressure bar is operated, smooth sliding of the air pressure bar is provided, whereby the structural strength of the table is reinforced.

6 Claims, 7 Drawing Sheets

ADJUSTABLE TABLE WITH AN ASSISTANT DEVICE

BACKGROUND OF THE INVENTION

1. Field of the Invention:

The present invention relates to height-adjustable tables, and more particularly, to an adjustable table with an assistant device.

2. Description of the Related Art:

Commonly known structures of adjustable tables are positioned and adjusted by sliding internal and external tubes, with positioning members and a row of holes arranged with certain intervals, whereby height of the tables are adjusted. However, such structure has a problem that the alignment between the positioning member and the holes needs to be taken into consideration of the way of adjusting, thus being inconvenient for the user while operating.

Later, another adjustable table with an air pressure bar as an adjusting device was invented, wherein the air pressure bar is applied for achieving the goal of speedily and continuously adjusting. Nevertheless, the stretching and contracting direction and force of the air pressure bar might cause lateral displacement of the air pressure bar during the operation, thereby not only interfering the operation of the adjusting device, but also shortening the service life of the air pressure bar. In addition, the screws combined to the table might loose easily. Therefore, the present invention is applied for improving the abovementioned disadvantages.

SUMMARY OF THE INVENTION

To solve the abovementioned problems, the present invention provides an adjustable table with an assistant device, which utilizes an assistant device with a structure of air pressure bar in order to enable the air pressure bar to slide smoothly and reinforce the structural strength of the table.

For achieving the objective above, the present invention as an adjustable table with an assistant device comprises a table board, with a first fastener and a second fastener on the bottom side; a first foot pivotally connected to the first fastener; a second foot pivotally connected to the first foot; a pivot joint pivotally connected to one end of the second foot; an air pressure bar is installed between the first fastener and the second fastener, wherein the air pressure bar possesses a stretching rod and a rod body, with one end of the stretching rod fixed on the second fastener; a lever, provided with a tab part, and pivotally connected to one end of the second fastener, whereby the tab part of the lever interacts with the stretching rod of the air pressure bar in order to make the air pressure bar stretch or shorten; an assistant device comprising at least one sliding stick positioned between the first fastener and the second fastener; a sliding member slidingly disposed around the sliding stick; and a combining piece fixed on one end of the sliding member and one end of the body of the air pressure bar simultaneously, wherein the sliding member together with the body of the air pressure bar relatively displace against the sliding stick when the air pressure bar is operated, in order to change the angle included by the first foot and the second foot, whereby height of the table is adjusted and the smooth sliding of the air pressure bar is provided; in addition, the structural strength of the table is reinforced.

For achieving the objective above, the assistant device of the present invention comprises another sliding stick and another sliding member slidingly disposed thereon. Also, the combining piece is disposed between the two sliding members, and the two sliding members are disposed on the two sliding sticks, respectively, whereby steady and smooth operation of the air pressure bar is provided, and the structural strength of the table is further reinforced.

DETAILED DESCRIPTION OF THE INVENTION

Figure 1:
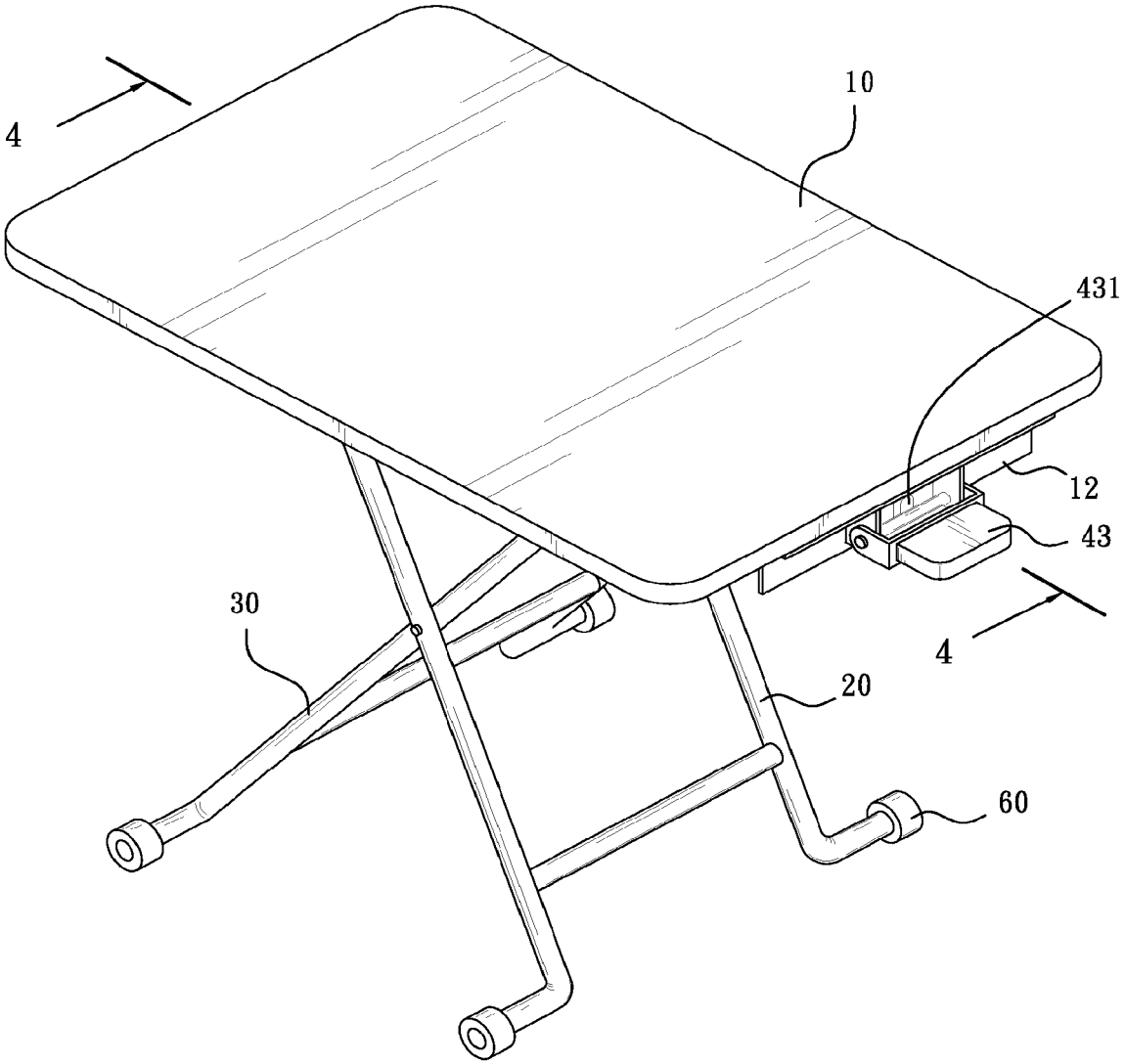
FIG. 1 is an assembled view of the present invention.
Figure 2:
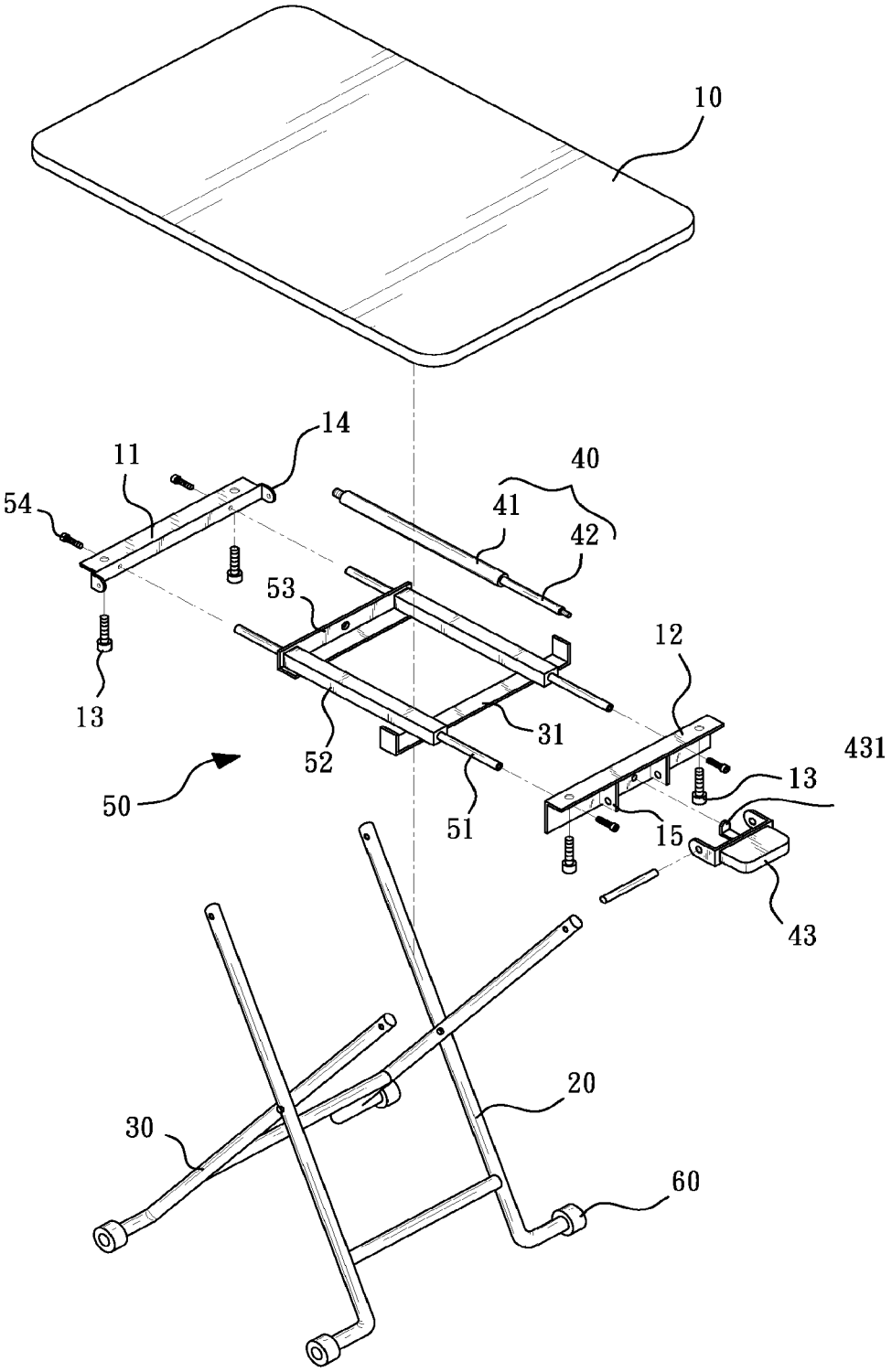
FIG. 2 is an exploded view of the present invention.
Figure 3:
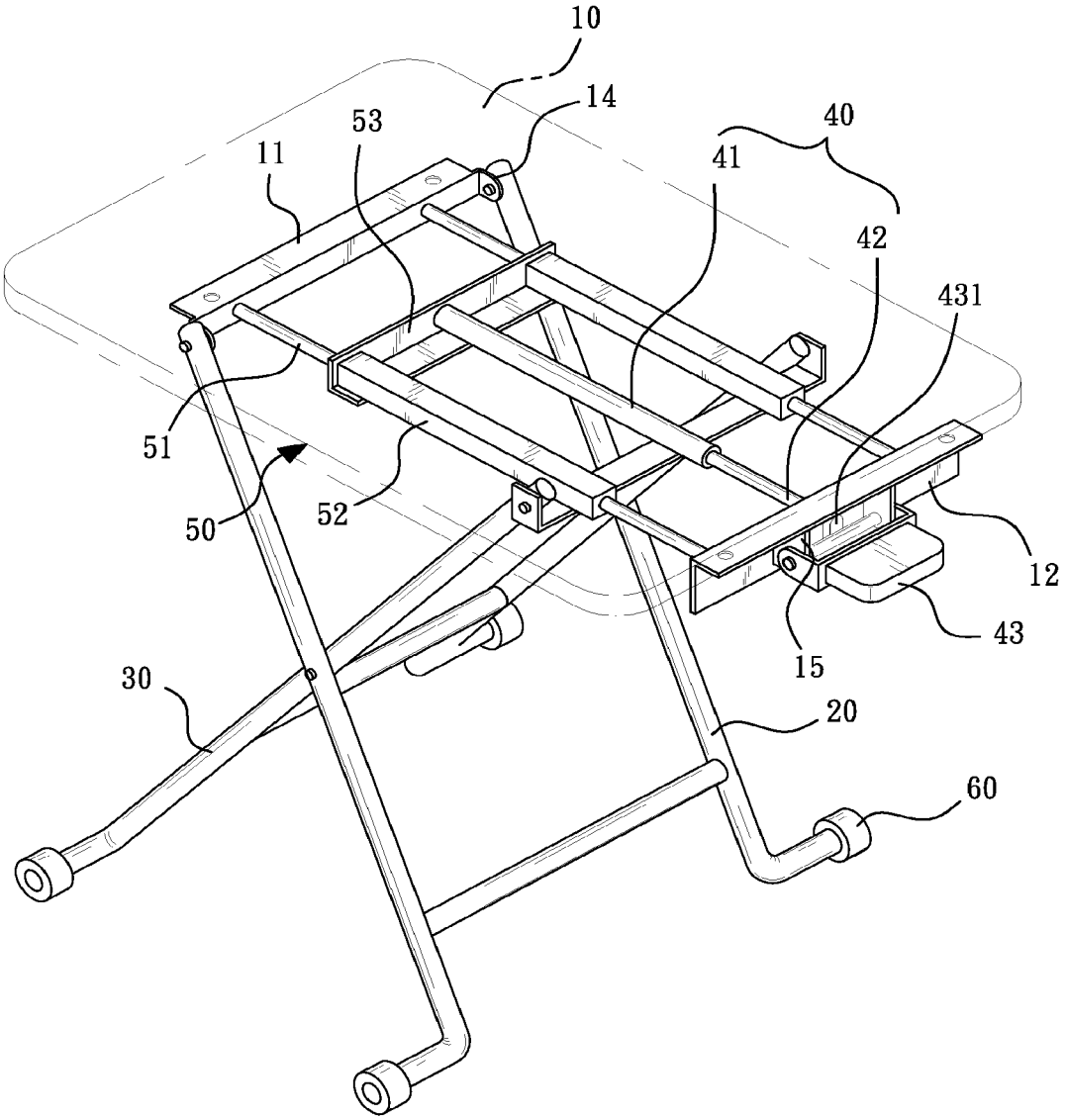
FIG. 3 is another assembled view of the present invention.

Referring to FIGS. 1-3, an adjustable table with an assistant device in accordance with the present invention is shown. The adjustable table with an assistant device comprises a table board 10, a first foot 20, a second foot 30, an air pressure bar 40 and an assistant device 50, wherein the middle section of the first foot 20 and the second foot 30 are pivotally connected as a cross shape, with wheels 60 installed at the end of the first foot 20 and the second foot 30, respectively.

The bottom side of the table board 10 possesses a first fastener 11 and a second fastener 12, wherein the first fastener 11 and the second fastener 12 are presented as a long strap shape and fixed on the bottom side of the table board 10 by several first screws 13. Two lateral hole plates 14 are settled at both ends of the first fastener 11 to pivotally connect with the top end of the first foot 20, and a couple of side connecting pieces 15 are settled on the outer-middle side of the second fastener.

A pivot joint 31 is pivotally connected at the top end of the second foot 30 and positioned between the first fastener 11 and the second fastener 12.

The air pressure bar 40 is fixed between the first fastener 11 and the second fastener 12, and positioned at the middle of the pivot joint 31. The air pressure bar 40 possesses a rod body 41 and a stretching rod 42, wherein the end of the stretching rod 42 is fixed between two side connecting pieces 15 of the second fastener 12.

A lever 43 having a tab part 431 is pivotally connected to the side connecting piece 15 of the second fastener 12, whereby the tab part 431 of the lever 43 interacts with the stretching rod 42 of the air pressure bar 40 in order to make the air pressure bar 40 stretch or shorten.

The assistant device 50 possesses two parallel sliding sticks 51, two sliding members 52 and one combining piece 53. The sliding sticks 51 are screwed between the first fastener 11 and the second fastener 12 by several second screws 54, whereby the whole structure of the table is reinforced and unlikely to be bent or deformed. The two sliding members 52 are slidingly disposed around the two sliding sticks 51, and the combining piece 53 is positioned between the two sliding members 52, wherein one end of the rod body 41 is fixed on the combining piece 53 and between the two sliding members 52.

Therein, when the air pressure bar 40 is being operated, the sliding members 52 together with the rod body 41 of the air pressure bar 40 relatively displace against the sliding sticks 51, thereby changing the angle included by the first foot 20 and the second foot 30, in order to adjust the height of the table.

Specifically, based on the same principle, the sliding sticks 51 and the sliding members 52 of the present invention are in a set of two identical units, while the same effect is also allowed to be achieved with the use of only one sliding stick 51 and one sliding member 52.

Figure 4:
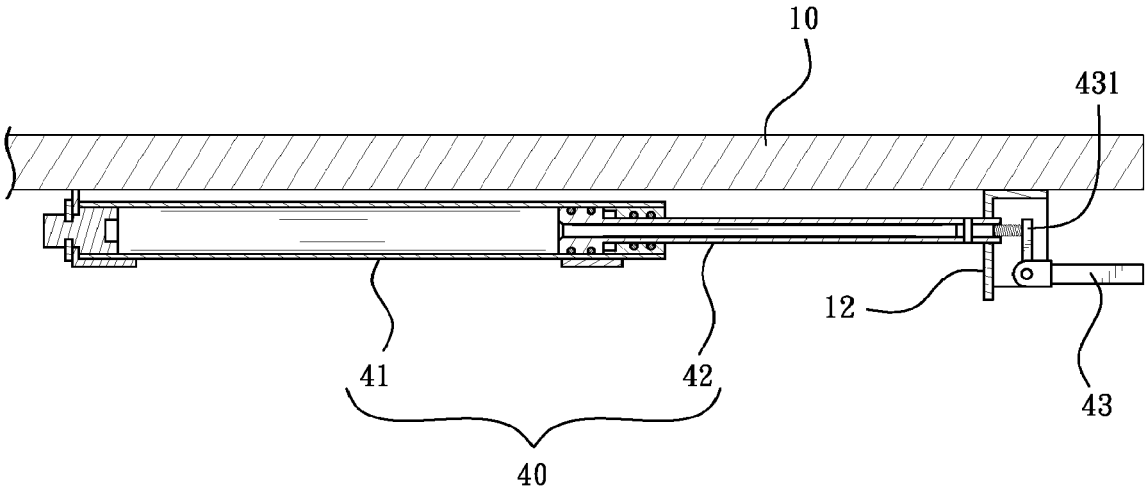
FIG. 4 is a partial sectional view of the present invention.

FIG. 4 is a partial sectioned view of the present invention, displaying that one end of the stretching rod 42 of the air pressure bar 40 is settled with the second fastener 12, and one end of the rod body 41 of the air pressure bar 40 is settled and positioned on the combining piece 53, whereby the air pressure bar 40 is operated to stretch or shorten by the lever 43; in addition, while the air pressure bar 40 is being operated, the stretching rod 42 is sliding smoothly against the rod body 41, whereby the deviation is prevented and further lower the lateral force received by the air pressure bar 40, thereby extending the service life of the air pressure bar 40.

Figure 5:
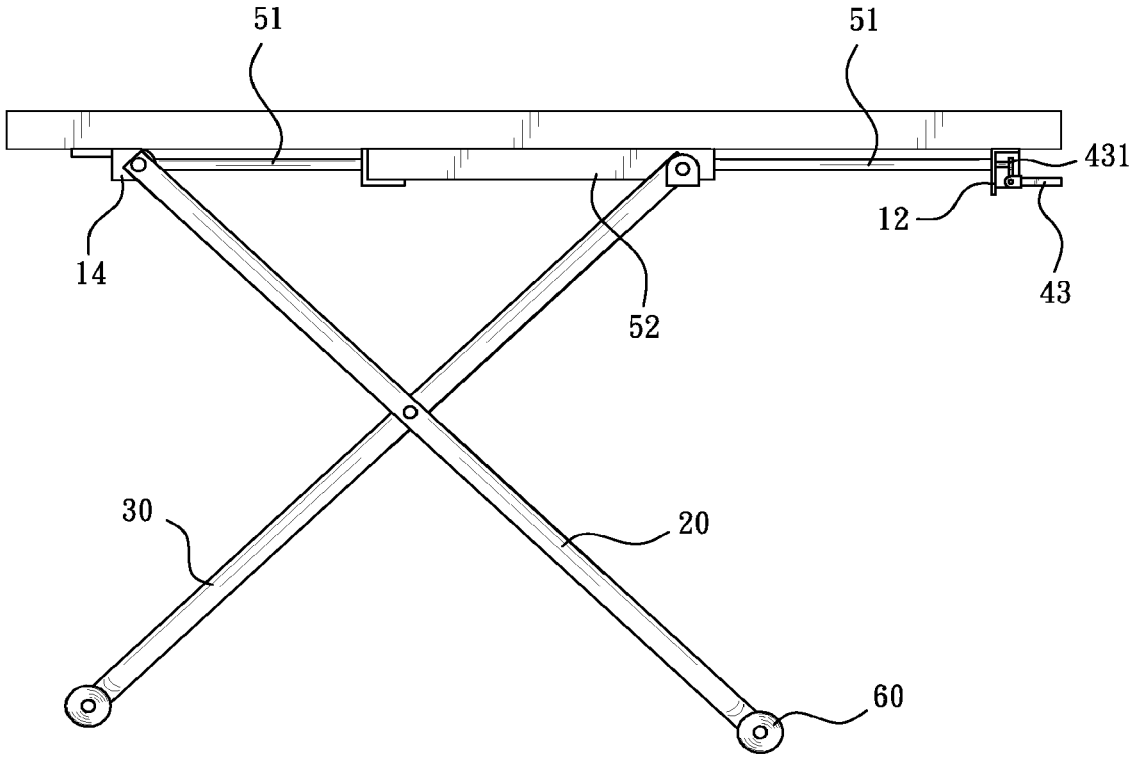
FIG. 5 is a side view of the present invention.

FIG. 5 is a side view of the present invention, showing that the first foot 20 and the second foot 30 of the present invention are pivotally connected as a cross shape to fully expand the table so that the table board 10 is parallel to the floor, and the wheels 60 are installed at the bottom ends of the first foot 20 and the second foot 30, thereby offering the function of conveniently moving.

Figure 6:
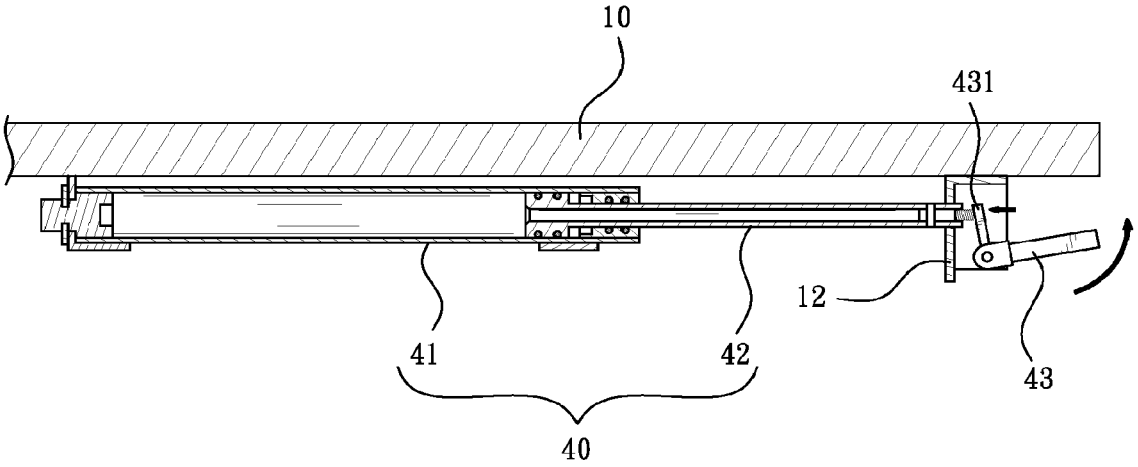
FIG. 6 is a schematic operational view of the present invention, illustrating the table being adjusted.

FIG. 6 is a schematic operational view of the present invention, illustrating that while desiring to store the table, user only needs to lift the lever 43 to push the bottom end of the stretching rod 42, thereby adjusting the corresponding opposite movement between the stretching rod 42 and the rod body 41, in order to adjust the height of the table.

Figure 7:
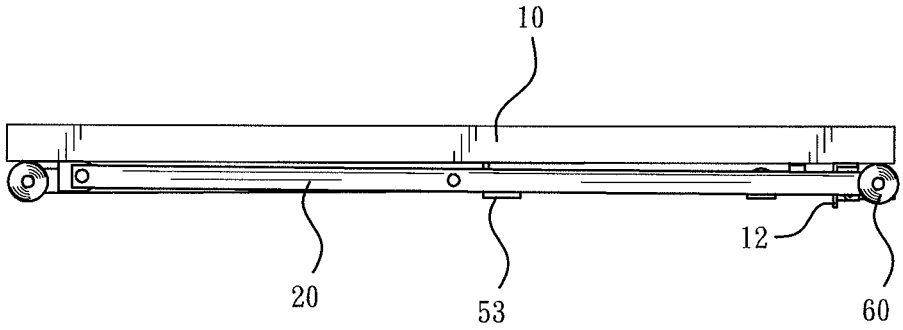
FIG. 7 is a schematic operational view of the present invention, illustrating the table being stored.

FIG. 7 is a schematic operational view of the present invention, illustrating the table being stored. Executing the aforementioned operation, the table presents a flat volume after adjustment, whereby the table is allowed to be stored in a relatively narrow space such as the space under a bed or a sofa, in order to achieve the objective of saving space.

In conclusion, the table of the present invention enables the sliding members to slide with the help of the assistant device, and fixes the combining piece between the two sliding members, thereby offering the function of smoothly sliding to the air pressure bar when operated, and reinforcing the whole structural strength of the table, together with the benefit of increasing the service life of the air pressure bar.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An adjustable table with an assistant device comprising:

a table board, with a first fastener and a second fastener on the bottom side thereof;

a first foot with one end pivotally connected to the first fastener;

a second foot pivotally connected with the first foot;

a pivot joint pivotally connected to one end of the second foot;

an air pressure bar installed between the first fastener and the second fastener, possessing a stretching rod and a rod body, wherein the bottom end of the stretching rod is fixed on the second fastener;

a lever, provided with a tab part, and pivotally connected to one end of the second fastener, whereby the tab part of the lever interacts with the stretching rod of the air pressure bar in order to make the air pressure bar stretch or shorten;

an assistant device, possessing at least one sliding stick installed between the first fastener and the second fastener, one sliding member slidingly disposed around the sliding stick, and a combining piece installed on one end of the sliding member and fixed with one end of the rod body of the air pressure bar;

wherein the sliding member together with the rod body of the air pressure bar displace corresponding to the sliding stick when the air pressure bar is operated, in order to change the angle included by the first foot and the second foot and further adjust height of the table.

2. An adjustable table with an assistant device of claim 1, wherein the assistant device comprises another sliding stick and another sliding member slidingly disposed on the sliding stick, and the combining piece is positioned between the two sliding members.

3. An adjustable table with an assistant device of claim 2, wherein two ends of the two sliding sticks are screwed on the first fastener and the second fastener, respectively.

4. An adjustable table with an assistant device of claim 2, wherein the air pressure bar is installed between the two sliding members.

5. An adjustable table with an assistant device of claim 1, wherein the first fastener has two lateral hole plates for one end of the first foot to be pivotally connected to.

6. An adjustable table with an assistant device of claim 1, wherein several wheels are installed on bottom ends of the first foot and the second foot, respectively.

* * * * *